US007192110B2

(12) United States Patent
Taguchi et al.

(10) Patent No.: US 7,192,110 B2
(45) Date of Patent: Mar. 20, 2007

(54) INKJET CARTRIDGE DETECTION AND SWITCHING APPARATUS

(75) Inventors: Akihiro Taguchi, Hachioji (JP); Nobuya Yamamoto, Hachioji (JP); Tetsushi Aoki, Hachioji (JP); Takashi Muramatsu, Hachioji (JP); Minoru Maekawara, Hachioji (JP); Shingo Tsubotani, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 247 days.

(21) Appl. No.: 10/916,957

(22) Filed: Aug. 11, 2004

(65) Prior Publication Data

US 2005/0035985 A1 Feb. 17, 2005

(30) Foreign Application Priority Data

Aug. 14, 2003 (JP) ..... 2003-293419
Feb. 4, 2004 (JP) ..... 2004-027557

(51) Int. Cl.
*B41J 2/195* (2006.01)
*B41J 29/393* (2006.01)
*B41J 2/175* (2006.01)

(52) U.S. Cl. ..... 347/7; 347/19; 347/85

(58) Field of Classification Search ..... 347/7
See application file for complete search history.

(56) References Cited

U.S. PATENT DOCUMENTS 4,432,005 A * 2/1984 Duffield et al. ..... 347/86
6,206,511 B1 * 3/2001 Cook et al. ..... 347/85
6,224,198 B1 * 5/2001 Cook et al. ..... 347/85
6,502,916 B1 * 1/2003 Naka ..... 347/14
6,511,142 B1 * 1/2003 Carmon et al. ..... 347/7
6,776,467 B2 * 8/2004 Yamazaki et al. ..... 347/7
6,796,627 B2 * 9/2004 Kimura et al. ..... 347/7

FOREIGN PATENT DOCUMENTS

JP 2002029041 A * 1/2002

* cited by examiner

*Primary Examiner*—Stephen Meier
*Assistant Examiner*—Shelby Fidler
(74) *Attorney, Agent, or Firm*—Cantor Colburn LLP

(57) ABSTRACT

An inkjet recording apparatus includes: exchangeable first and second ink cartridges; a recording head which jets ink to a recording medium; an intermediate tank which receives the ink from the ink cartridge and supplies the ink to the recording head; a detecting sensor which detects whether ink residual quantity of an ink cartridge is not more than predetermined quantity based on ink quantity in the intermediate tank; a switching section which, if the ink residual quantity is not more than the predetermined quantity, switches the ink cartridge for supplying the ink to the intermediate tank; a first detector which detects the reset of the first ink cartridge; a second detector which detects the reset of the second ink cartridge; and a controller which, if the first ink cartridge is reset, controls the switching section to switch the second ink cartridge to the first ink cartridge, for supplying the ink.

20 Claims, 11 Drawing Sheets

FULL STATE

NOT FULL STATE

FULL STATE

NOT FULL STATE

INKJET CARTRIDGE DETECTION AND SWITCHING APPARATUS

BACKGROUND OF THE INVENTION

1. Field of the Invention

The invention relates to an inkjet recording apparatus.

2. Description of Related Art

So far, what is known as an inkjet recording apparatus is, for example, an apparatus comprising a recording head for jetting ink toward a recording medium, a plurality of ink cartridges each of which comprises the recording head and an ink pool unit for pooling ink to be supplied to the recording head, a carriage which contains the plurality of ink cartridges and which moves back and forth along a main scanning direction over the recording medium, an ink residual quantity detecting section for detecting that ink residual quantity pooled in the ink pool unit of an ink cartridge being used becomes zero or not more than predetermined quantity, an ink cartridge switching section for switching the ink cartridge to new one when the ink residual quantity detecting section detects that ink residual quantity of the ink cartridge becomes zero or not more than the predetermined quantity, and the like (for example, see Japanese Patent No. 3131964).

Further, what is also known is an inkjet recording apparatus comprising a plurality of ink cartridges for pooling ink of the same color, wherein ink residual quantity within each ink cartridge is detected with a provided residual quantity detecting sensor with each ink cartridge, and with a switching section switching an ink cartridge to be used, it is possible to prevent from stopping a recording operation (for example, Japanese Patent Application Publication (Unexamined) No. Tokukai 2002-29041).

By the way, since an ink cartridge is contained in a carriage in the inkjet recording apparatus of the above-mentioned structure, in order to switch the ink cartridge during a recording operation, it is necessary to stop the printing temporarily. Therefore, an inkjet recording apparatus capable of switching an ink cartridge without stopping a printing during a printing operation by providing an ink cartridge and a carriage individually, has been developed (for example, see Japanese Patent Application Publication (Unexamined) No. Tokukaihei 4-10954).

However, although it is possible to switch an ink cartridge without stopping the printing during a recording operation with the ink cartridge and a carriage provided individually as the mentioned way, since there are some ink cartridges of which it is not possible to confirm residual quantity of ink based on its appearance, there is a possibility of loading an empty ink cartridge by mistake. If an empty ink cartridge is loaded, when an ink cartridge which is currently being used becomes empty and the ink supply source is switched to the loaded ink cartridge, ink is not supplied to the recording head and thereby a printing has to be stopped.

Further, with a structure in which each of the plurality of ink cartridges comprises a residual quantity detecting sensor, since it is necessary to have a large number of expensive residual quantity detecting sensors, it is costwise inefficient.

SUMMARY OF THE INVENTION

An object of the present invention is to provide an inkjet recording apparatus which is capable of preventing a printing stop due to ink residual quantity of an ink cartridge becoming not more than predetermined quantity during a recording operation, and of detecting ink residual quantity without providing an ink residual quantity detecting sensor individually to each ink cartridge.

In order to achieve the above-mentioned object, in accordance with a first aspect of the present invention, an inkjet recording apparatus comprises: a first ink cartridge which is exchangeable; a second ink cartridge which is exchangeable; a recording head which jets ink to a recording medium; an intermediate tank which receives the ink selectively from the first ink cartridge or the second ink cartridge, the intermediate tank supplying the received ink to the recording head; a detecting sensor which detects whether ink residual quantity of an ink cartridge supplying the ink is not more than first predetermined quantity, based on quantity of the ink in the intermediate tank; a switching section which, if the detecting sensor detects that the ink residual quantity of the ink cartridge supplying the ink is not more than the first predetermined quantity, switches the ink cartridge to another ink cartridge for supplying the ink to the intermediate tank; a first detector which detects whether the first ink cartridge is reset to the inkjet recording apparatus; a second detector which detects whether the second ink cartridge is reset to the inkjet recording apparatus; and a controller which, if the first detector detects that the first ink cartridge is reset, controls the switching section to switch the second ink cartridge to the first ink cartridge, for supplying the ink to the intermediate tank.

In accordance with another aspect of the present invention, an inkjet recording apparatus comprises: a first ink cartridge which is exchangeable; a second ink cartridge which is exchangeable; a recording head which jets ink to a recording medium; a switching section which switches an ink supply source for the recording head to the first ink cartridge or the second ink cartridge; a first detector which detects whether the first ink cartridge is reset to the inkjet recording apparatus; a second detector which detects whether the second ink cartridge is reset to the inkjet recording apparatus; and a controller which, if the first detector detects that the first ink cartridge is reset, controls the switching section to switch the ink supply source for the recording head to the first ink cartridge.

Objects, features and advantages of the above and others according to the present invention will be made more clear by the following detailed description based on the attached figures.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENTS OF THE INVENTION

Hereinafter, embodiments of the present invention will be described with reference to figures.

[First Embodiment]

Figure 1:
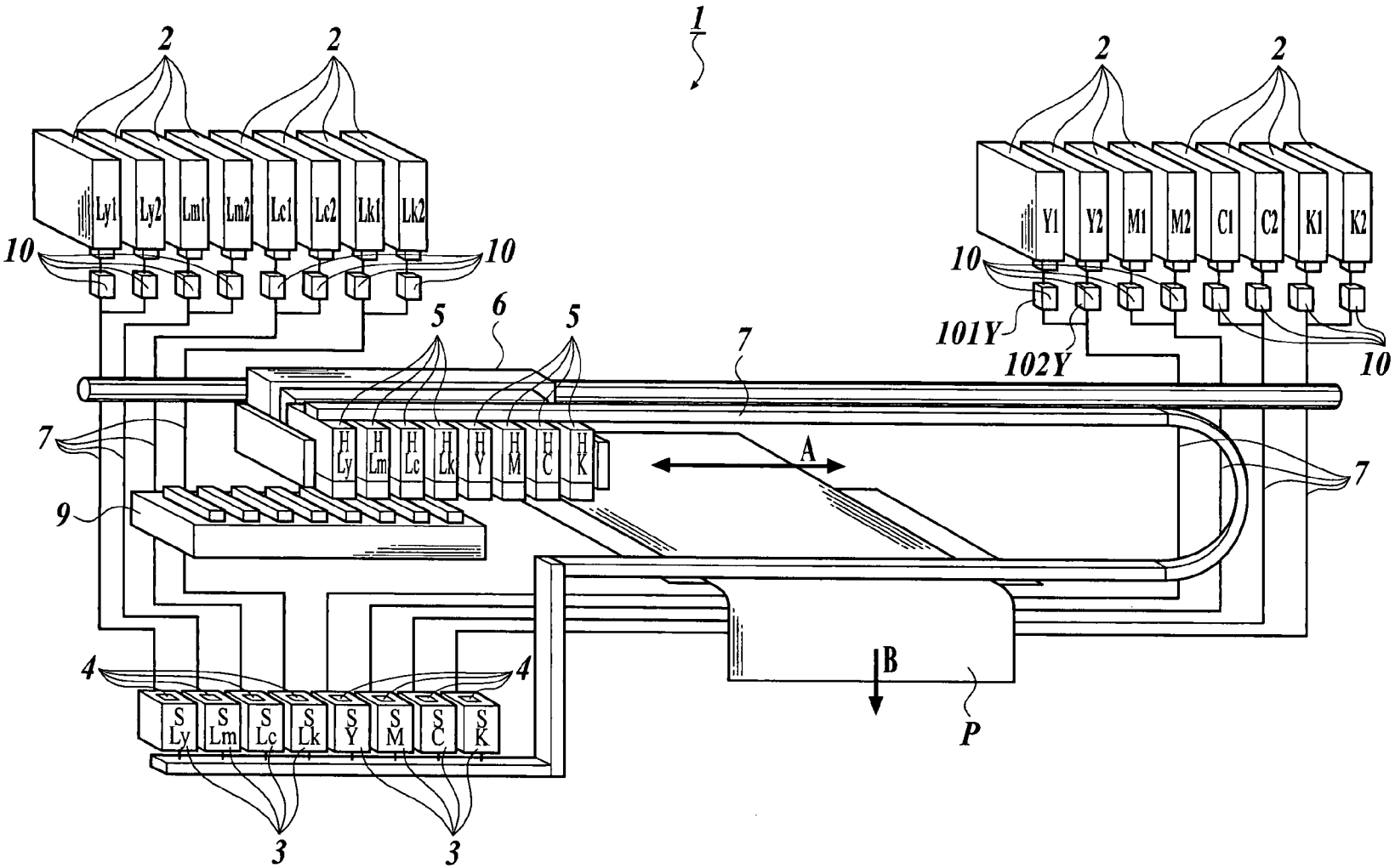
FIG. 1 is a view showing a whole structure of an inkjet recording apparatus according to the present invention.

FIG. 1 is a view showing a whole structure of an inkjet recording apparatus according to the present invention.

Figure 3:
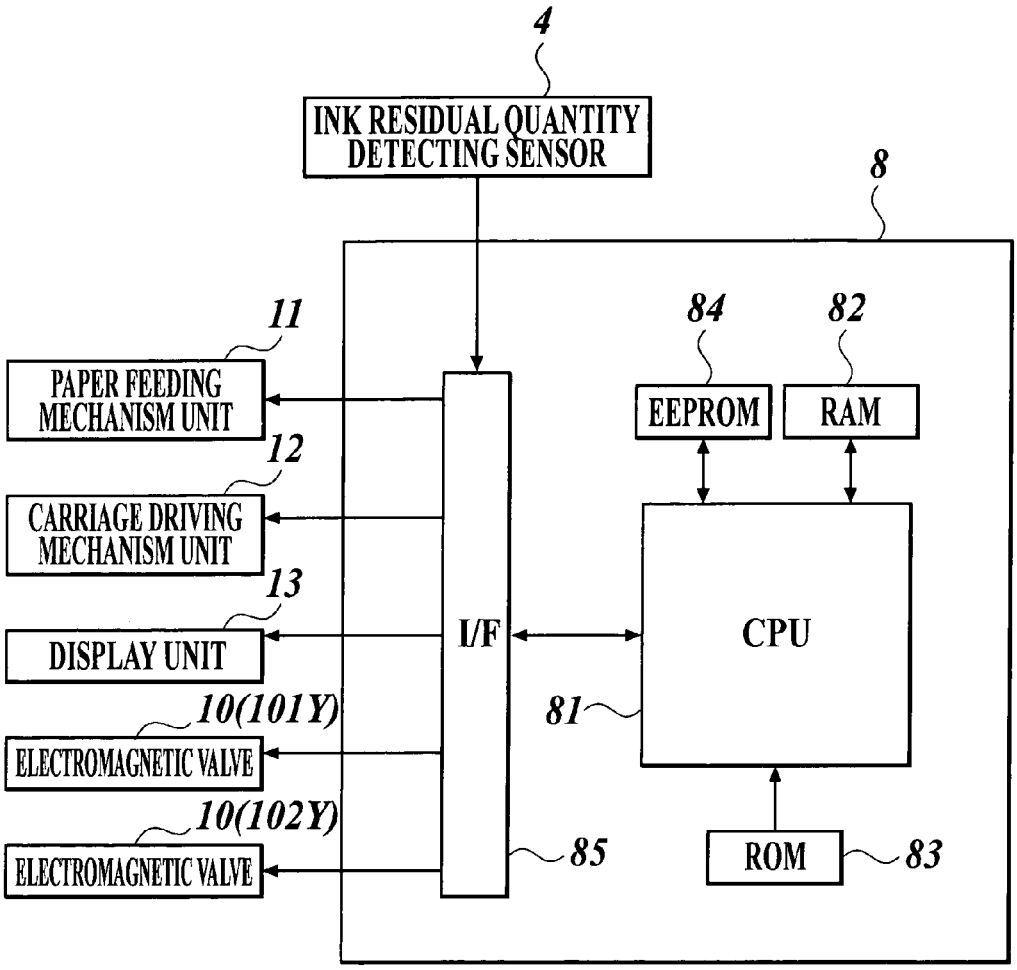
FIG. 3 is a block diagram showing a main control structure of the inkjet recording apparatus according to the present invention.

As shown in FIG. 1, an inkjet recording apparatus 1 comprises ink cartridges 2 each of which pools ink of each color, intermediate tanks 3 to which the ink cartridges 2 supply the ink, ink residual quantity detecting sensors 4 as an ink residual quantity detecting section provided in the intermediate tanks 3, recording heads 5 to which the ink is supplied from the intermediate tanks 3 and which jet the ink toward paper P as a recording medium, a carriage 6 which contains the recording heads 5 and which is capable of moving back and forth along a main scanning direction A, an ink supply tube 7 for supplying the ink from the ink cartridges 2 to the recording heads 5, a control unit 8, which is shown in FIG. 3, for controlling operations of each of the above-mentioned parts, and the like.

In the ink cartridges 2, two cartridges for each color corresponding to black (K), light black (Lk), cyan (C), light cyan (Lc), magenta (M), light magenta (Lm), yellow (Y) and light yellow (Ly) are provided so as to be exchangeable. For example, in the case of yellow (Y), as shown in FIG. 1, two cartridges which are a first yellow ink cartridge 2 (Y1) and a second yellow ink cartridge 2 (Y2) are provided. These ink cartridges 2 are not mounted on the carriage 6, but separately provided from the carriage 6.

The recording heads 5 comprise recording heads which are capable of jetting each color of HK, HLk, HC, HLc, HM, HLm, HY and HLy, respectively. For example, to a recording head 5 (HY), ink is supplied from either the first yellow ink cartridge 2 (Y1) or the second yellow ink cartridge 2 (Y2). The recording heads 5 are contained in the carriage 6, and they follow the back-and-forth movement of the carriage 6. When the recording heads 5 and the carriage 6 are not involved with a recording operation, they are at a home position 9, which is secured at one side of the movement edges of the carriage 6, to stand by.

The intermediate tanks 3 are tanks for temporarily pooling ink of each color that is pooled in the ink cartridges 2, and are provided between the ink cartridges 2 and the recording heads 5. The intermediate tanks 3 are provided so as to correspond to each color of SK, SLk, SC, SLc, SM, SLm, SY and SLy. For example, to the intermediate tank 3 (SY), ink is supplied from either the first yellow ink cartridge 2 (Y1) or the second yellow ink cartridge 2 (Y2). To the intermediate tanks 3, recording heads 5 of corresponding color are connected respectively, and ink which is temporarily pooled in the intermediate tank 3 is supplied to the recording head 5. Therefore, for example, ink in either the first yellow ink cartridge 2 (Y1) or the second yellow ink cartridge 2 (Y2) is supplied to the recording head 5 (HY) via the intermediate tank 3 (SY).

The intermediate tanks 3 are provided at a lower position than the ink cartridges 2. The ink pooled in the ink cartridges 2 is supplied to each intermediate tank 3 according to its own weight.

Further, for example, the intermediate tanks 3 are made of deformable material such as polyethylene or the like. Thereby, a volume of the intermediate tank 3 can be changed according to residual quantity of ink supplied from the ink cartridges 2.

Figure 2:
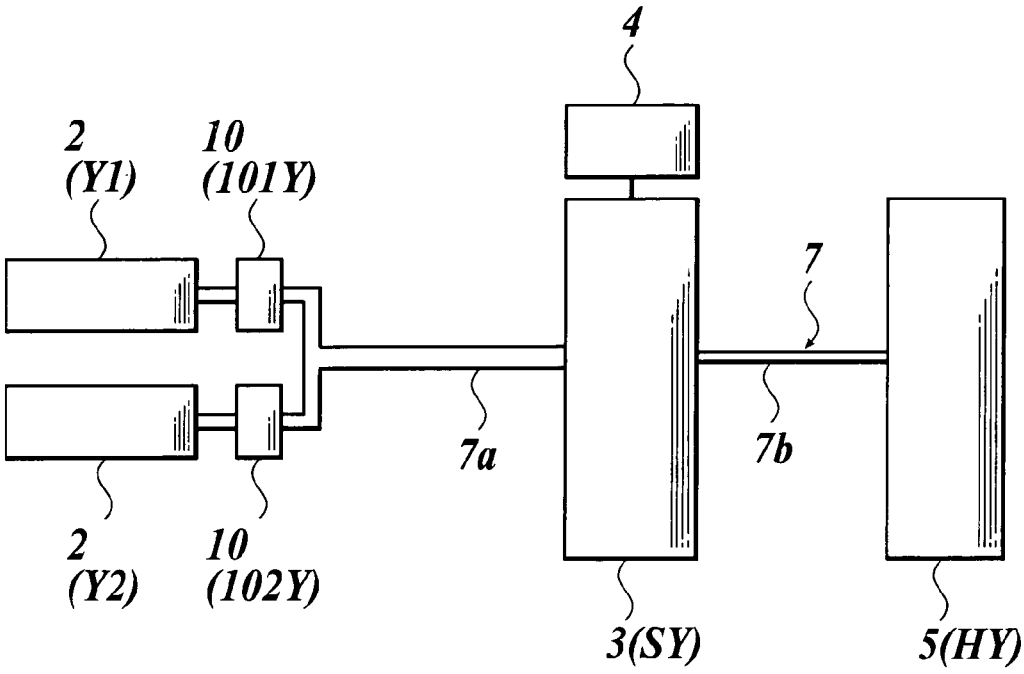
FIG. 2 is a pattern diagram describing ink supply in the inkjet recording apparatus according to the present invention.

The ink supply from the ink cartridges 2 to the intermediate tanks 3 is done at each ink color through the ink supply tube 7. As shown in FIG. 2, for example, diameter of an ink supply tube 7*a* for connecting from the first yellow ink cartridge 2 (Y1) or the second yellow ink cartridge 2 (Y2) to the intermediate tank 3 (SY) is made larger than that of an ink supply tube 7*b* for connecting from the intermediate tank 3 (SY) to the recording head 5 (HY). Thereby, ink is pooled in the intermediate tank SY. Therefore, as ink is being supplied from the first yellow ink cartridge 2 (Y1) or the second yellow ink cartridge 2 (Y2), a volume of the intermediate tank 3 (SY) is changed in the increasing direction.

The ink residual quantity detecting sensor 4 is provided in each intermediate tank 3 so that the ink residual quantity detecting sensor 4 is capable of detecting ink residual quantity of an ink cartridge which is currently being used and is one of the two ink cartridges of each color. For example, an ink residual quantity detecting sensor 4 provided in the intermediate tank 3 (SY) shown in FIG. 2 detects ink residual quantity of an ink cartridge which is currently being used and is one of the first yellow ink cartridge 2 (Y1) and the second yellow ink cartridge 2 (Y2).

Next, with reference to FIGS. 5A to 5E, ink residual quantity detection with the intermediate tank 3 in the present embodiment will be described in detail.

The intermediate tank 3 in the present embodiment is a bag-type container which changes its volume according to supplied ink quantity, and the intermediate tank 3 is provided so as to contact one side thereof to a fixing surface 60 which is positioned vertically. To the intermediate tank 3, connected are an ink supply tube 61 linked from the ink cartridge and an ink supply tube 62 for the recording head. Further, on the opposite side to the side contacting the fixing surface 60 of the intermediate tank 3, provided is an actuator 63 protrudingly. As ink quantity within the intermediate tank 3 increases, the actuator 63 is moved further from the fixing surface 60.

Figure 5B:
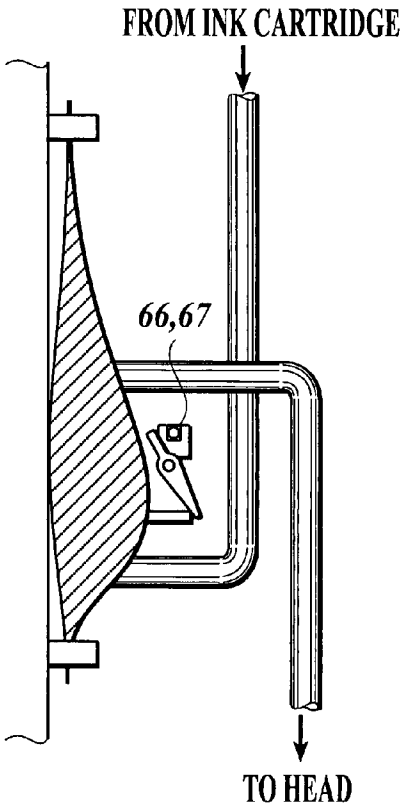
FIGS. 5A to 5D are pattern diagrams showing an operation state of an ink residual quantity detecting sensor provided in an intermediate tank according to the present invention.
Figure 5A:
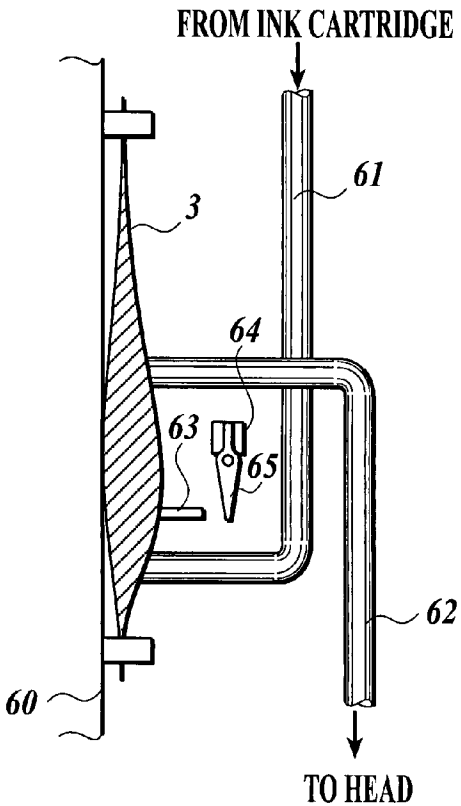

In the moving direction of the actuator 63, as shown in FIG. 5A and FIG. 5B for example, arranged is an ink residual quantity detecting sensor 64 which comprises a photo sensor and the like. Near the ink residual quantity detecting sensor 64, provided is a sensor lever 65 rotatably for opening/blocking light path of the ink residual quantity detecting sensor 64 by a rotating operation. Then, with the actuator 63 pushing the bottom part of the sensor lever 65 according to ink quantity increase within the intermediate tank 3, the sensor lever 65 is rotated and thereby the light path of the ink residual quantity detecting sensor 64 is opened. Then, with a light receiving device 67 detecting light emitted from a light emitting device 66, it is possible to detect that the ink residual quantity of the intermediate tank 3 is full.

Figure 5D:
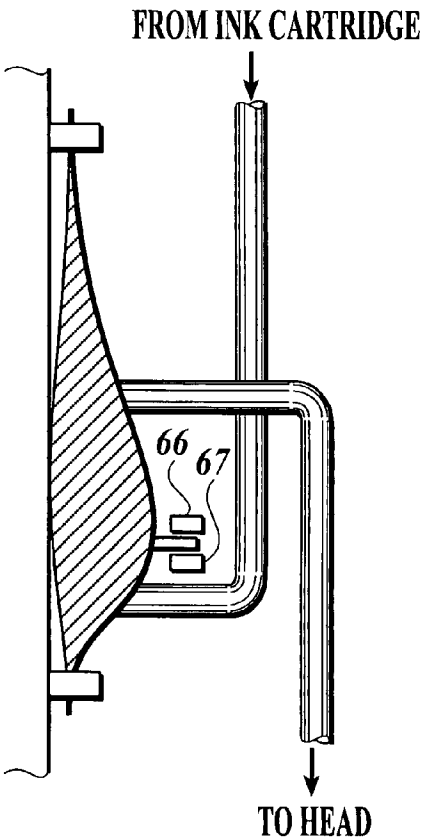
Figure 5C:
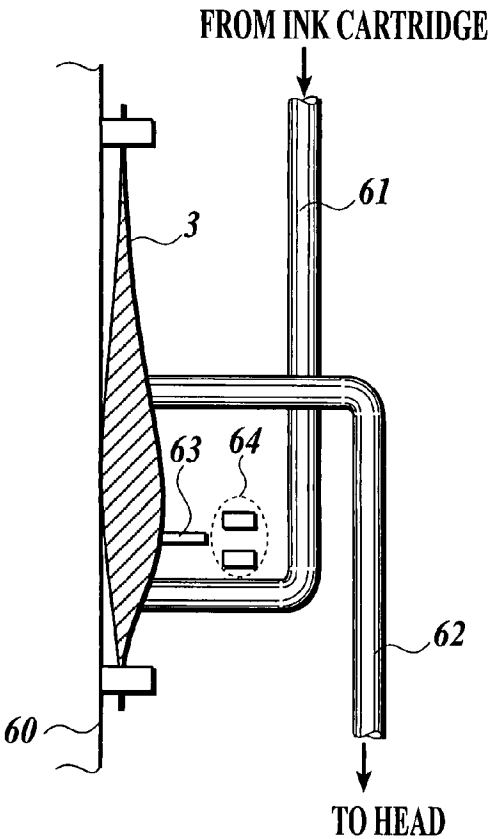

Further, the ink residual quantity detecting sensor 64 is not limited to the above-described structure. For example, as shown in FIG. 5C and FIG. 5D, in the moving direction of the actuator 63 which is provided so that the actuator 63 is moved further from the fixing surface 60 according to ink quantity increase, the light emitting device 66 and the light receiving device 67 may be provided in an interval so as to face each other. In this case, while the light receiving device 67 is detecting light emitted from the light emitting device 67, ink residual quantity is not more than predetermined quantity, and with the actuator 63 moved further from the fixing surface according to ink residual quantity increase, light emitted from the light emitting device 66 is blocked for preventing the light receiving device 67 from detecting the light, and a detection of the intermediate tank 3 being full may be done.

Figure 5E:
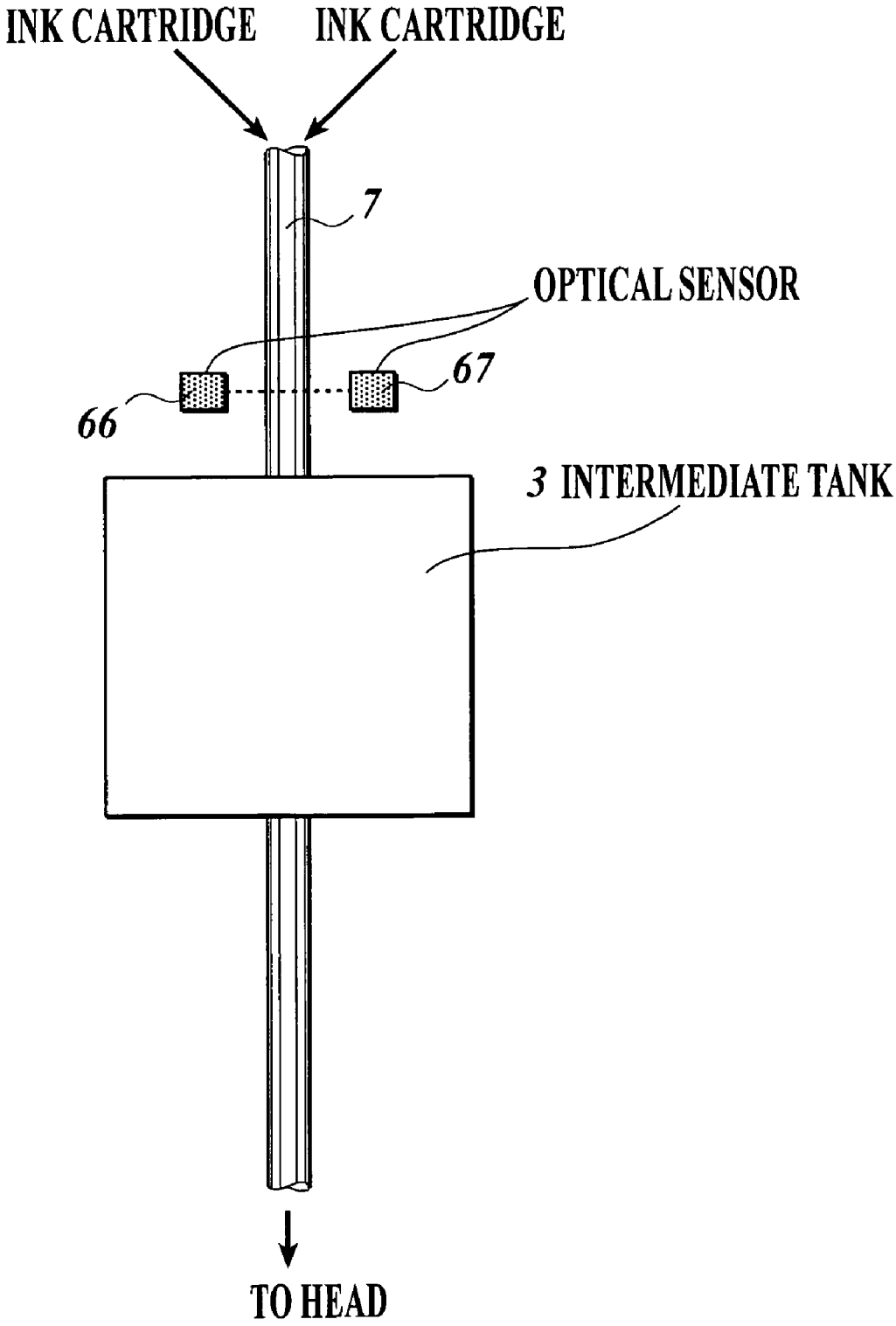
FIG. 5E is a view showing a pattern diagram showing another type of ink residual quantity detecting sensor according to the present invention.

Further, as shown in FIG. 5E where the light emitting device 66 and the light receiving device 67 are provided so as to face each other at both the sides with respect to the ink supply tube 7, through which ink supplied from the plurality of ink cartridges passes, the ink residual quantity detecting sensor 64 may comprise an optical sensor at the upstream side of the intermediate tank 3 and near the ink passage for optically detecting transmittance within the passage. In this case, it is preferable to apply a transparent or translucent pipe, tube or the like to the ink supply tube 7. In this way, it is possible to easily detect whether ink passes within the ink supply tube 7. Thereby, it is possible to surely detect ink residual quantity of the ink cartridge which is currently supplying the ink to the intermediate tank 3.

Further, this ink residual quantity detecting sensor 4 is a sensor for detecting ink residual quantity according to a swelling condition of the intermediate tank 3. For example, while the second ink cartridge 2 (Y2) supplies ink to the intermediate tank 3 (SY) as shown in FIG. 2, if each ink residual quantity detecting sensor 4 detects that there is no swelling with the intermediate tank 3 (SY) after predetermined time period has passed, it is judged that ink residual quantity of the second ink cartridge 2 is not more than predetermined quantity, and its detecting signal is inputted to the control unit 8.

Between the ink cartridges 2 and the intermediate tanks 3, provided is an electromagnetic valve 10 which is opened/closed electromagnetically according to a control by the control unit 8. The electromagnetic valve 10 is provided in each ink cartridge, and is controlled so as to supply ink from one of the two ink cartridges of the same color.

Here, with reference to FIG. 2, a switching operation of ink supply from the ink cartridges 2 at the electromagnetic valve 10 will be described in detail. For example, an electromagnetic valve 10 (101Y) is provided in the first yellow ink cartridge 2 (Y1) and an electromagnetic valve 10 (102Y) is provided in the second yellow ink cartridge 2 (Y2). By having one of the electromagnetic valve 10 (101Y) and the electromagnetic valve 10 (102Y) opened and by having another closed, one of the first yellow ink cartridge 2 (Y1) and the second yellow ink cartridge 2 (Y2) is connected to the ink supply tube 7 for supplying ink to the intermediate tank 3 (SY). Further, other than the present embodiment in which one of the first yellow ink cartridge 2 (Y1) and the second yellow ink cartridge 2 (Y2) can supply ink with an electromagnetic valve 10 provided on each ink cartridge, it is possible to perform an operation to have both the ink cartridges supply ink, or an operation to have no ink cartridge supply ink. Furthermore, for example, it is possible to obtain an effect of adjusting pressure of supplied ink at the nozzle part of the recording head.

Next, an internal structure of the inkjet recording apparatus 1 will be described.

FIG. 3 is a block diagram showing a main control structure of the inkjet recording apparatus 1 of FIG. 1. As shown in FIG. 3, the control unit 8 comprises a CPU 81, a RAM 82, a ROM 83, an EEPROM 84, an interface (I/F) 85 and the like. Via the interface 85, the control unit 8 is electrically connected to the ink residual quantity detecting sensor 4, the electromagnetic valve 10 (for example, 101Y), the electromagnetic valve 10 (for example, 102Y), a paper feeding mechanism unit 11 for feeding paper P as a recording medium in a sub scanning direction B, a carriage driving mechanism unit 12 for moving the carriage 6 back and forth, a display unit 13 and the like.

The CPU 81 operates (executes) a program stored in the ROM 83 into an operation area of the RAM 82.

Concretely, the CPU 81 functions as a judgment section for judging whether an exchange of an ink cartridge is done during a recording operation. This judgment is, for example, done by reading information of an exchanged ink cartridge and recognizing whether an exchange of the ink cartridge is done or not based on the read information.

Further, if the CPU 81 judges that the exchange of an ink cartridge is done, the CPU 81 functions as a part of a storing section for storing identification information which indicates a first ink cartridge being used (for example, identification number or the like) in the RAM 82, which is a part of the storing section.

Further, the CPU 81 functions as a control section which operates as follows: with the use of the electromagnetic valve 10 (101Y) and the electromagnetic valve 10 (102Y) that function as a switching section, the control section controls a switching of ink supply for the recording head 5, from a first ink cartridge which is currently being used (for example, the first yellow ink cartridge 2 (Y1)) to a second ink cartridge to which an exchange of an ink cartridge is done (for example, the second yellow ink cartridge 2 (Y2)), and also controls a detection of ink residual quantity of the second yellow ink cartridge 2 (Y2) with the use of the ink residual quantity detecting sensor 4. This switching is done by electromagnetically opening the electromagnetic valve 10 (102Y) of the second yellow ink cartridge 2 (Y2) and closing the electromagnetic valve 10 (101Y) of the first yellow ink cartridge 2 (Y1).

Further, the CPU 81 functions as a control section which operates as follows: after a detecting signal of ink residual quantity is inputted by the ink residual quantity detecting sensor 4, based on the identification number indicating the first yellow ink cartridge 2 (Y1) stored in the RAM 82, the CPU 81 controls a switching of ink supply for the recording head 5, from the second yellow ink cartridge 2 (Y2) to the first yellow ink cartridge 2 (Y1) with the use of the electromagnetic valve 10 (101Y) and the electromagnetic valve 10 (102Y) that function as the switching section. This switching is done by electromagnetically opening the electromagnetic valve 10 (101Y) of the first yellow ink cartridge 2 (Y1) and closing the electromagnetic valve 10 (102Y) of the second yellow ink cartridge 2 (Y2).

Further, if a detecting signal indicating that ink residual quantity of the exchanged ink cartridge is not more than predetermined quantity is inputted from the ink residual quantity detecting sensor 4, the CPU 81 controls a informing section to inform accordingly. More concretely, the CPU 81 controls the informing section to display ink residual quantity information on the display unit 13.

Furthermore, if ink residual quantity of one of the first ink cartridge and the second ink cartridge is determined as not more than predetermined quantity, the CPU 81 gives a first warning notice. Thereafter, if ink residual quantity of both the first ink cartridge and the second ink cartridge is determined as not more than predetermined quantity, the CPU 81 gives a second warning notice. Thereafter, if an exchange of the first ink cartridge or the second ink cartridge has not done even after predetermined time period passed, the CPU 81 gives a third warning notice.

Here, when the third warning notice is given, the CPU 81 stops recording images.

Further, after recording images is stopped, if it is judged that an exchange of one of the two ink cartridges is done by changing the first ink cartridge or the second ink cartridge, and ink residual quantity of the intermediate tank is not less than predetermined quantity, recording images is resumed.

The RAM 82 comprises a storing area which is capable of storing a plurality of various types of inputted data while electric power is being supplied, an operation area for the CPU 81, and the like.

The ROM 83 stores various types of data regarding control of the paper feeding mechanism unit 11 and the carriage driving mechanism unit 12, various types of control programs and control data regarding operations of each part of the inkjet recording apparatus 1, and the like.

The EEPROM 84 is a nonvolatile memory comprising a storing area for storing various types of data which are temporarily stored in the storing area of the RAM 82, for the purpose of storing them while the power is off.

The display unit 13 comprises, for example, an LCD (Liquid Crystal Display) or the like. The display unit 13 functions as a displaying section for displaying ink residual quantity information, and as the informing section, according to the control by the CPU 81.

Figure 4:
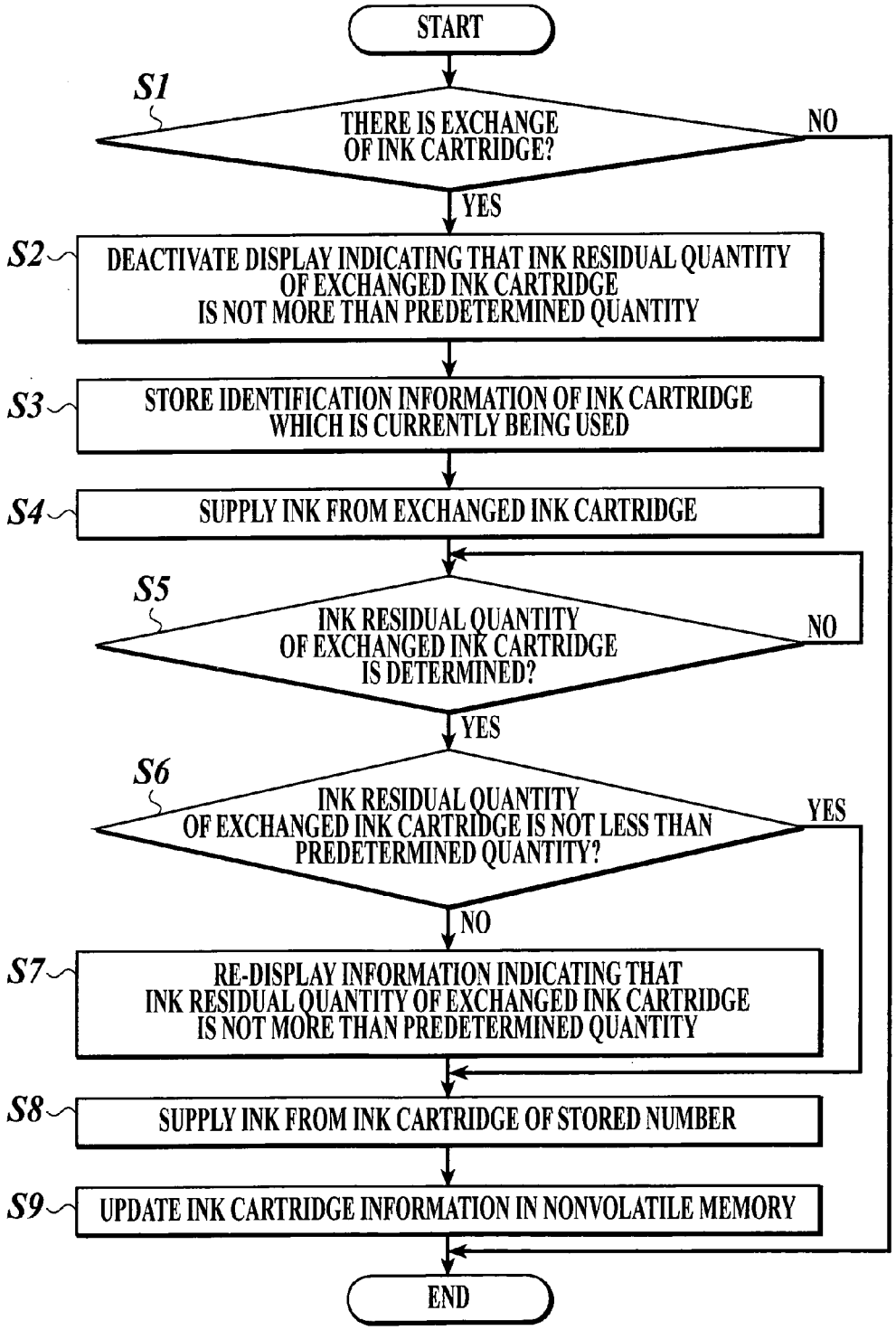
FIG. 4 is a flowchart illustrating an ink residual quantity detecting process operation in the ink-jet recording apparatus according to the present invention.

Next, an ink residual quantity detecting process operation of the inkjet recording apparatus 1 having the above-mentioned structure at the time of exchanging an ink cartridge will be described with reference to a flowchart shown in FIG. 4.

As a condition before entering the ink residual quantity detecting process operation, for example, it is assumed that ink residual quantity of the second yellow ink cartridge 2 (Y2) is already not more than predetermined quantity, and ink residual quantity information being in that state is displayed on the display unit 13. In this case, it is assumed that the first ink cartridge is currently being used.

At first, in the inkjet recording apparatus 1, the CPU 81 judges whether an ink cartridge exchange is done during a recording operation (Step S1). Then, if the CPU 81 judges that an ink cartridge exchange is done (Step S1; Yes), the CPU 81 executes a process to deactivate the already-shown display, indicating that ink residual quantity of the second ink cartridge 2 (Y2) is not more than predetermined quantity (Step S2). Then, the CPU 81 stores identification number of the first ink cartridge, which is being used, in an identification number storing area of the RAM 82 (Step S3). Here, if the currently-used first ink cartridge is, for example, the first yellow ink cartridge 2 (Y1), and the identification number is, for example, "001", the CPU 81 stores this identification number "001" in the RAM 82.

Next, the CPU 81 switches ink supply for the recording head 5 (HY) from the first yellow ink cartridge 2 (Y1) to the exchanged second yellow ink cartridge 2 (Y2) (Step S4). Concretely, the CPU 81 closes the electromagnetic valve 10 (101Y) which is connected to the first yellow ink cartridge 2 (Y1), and opens the electromagnetic valve 10 (102Y) which is connected to the second yellow ink cartridge 2 (Y2), for making the second yellow ink cartridge 2 (Y2) supply ink.

Next, the CPU 81 determines ink residual quantity of the switched second yellow ink cartridge 2 (Y2) based on a detecting signal from the ink residual quantity detecting sensor 4 (Step S5). Concretely, while the second yellow ink cartridge 2 (Y2) supplies ink to the intermediate tank 3 (SY), if predetermined time period has passed (Step S5; Yes), the CPU 81 judges that ink residual quantity is determined.

On the contrary, the CPU 81 stands by until the predetermined time period passes (Step S5; No).

Next, the CPU 81 judges whether the ink residual quantity of the switched second yellow ink cartridge 2 (Y2) is not less than the predetermined quantity based on the detecting signal from the ink residual quantity detecting sensor 4 (Step S6). Concretely, while the second yellow ink cartridge 2 (Y2) supplies ink to the intermediate tank 3 (SY), if the ink residual quantity detecting sensor 4 detects that there is no swelling with the intermediate tank 3 (SY) after the predetermined time period has passed, the CPU 81 judges that the ink residual quantity of the second yellow ink cartridge 2 (Y2) is not more than the predetermined quantity (Step S6; No).

Then, the CPU 81 re-displays ink residual quantity information on the display unit 13, the ink residual quantity information indicating that the ink residual quantity is not more than the predetermined quantity (Step S7). This display allows a user to visually confirm that the ink residual quantity of the exchanged second yellow ink cartridge 2 (Y2) is not more than the predetermined quantity, and prompts the user to exchange the second yellow ink cartridge 2 (Y2).

Thereafter, based on the identification number "001" of the first ink cartridge 2 (Y1) stored in the identification number storing area of the RAM 82, the CPU 81 opens the electromagnetic valve 10 (101Y) and closes the electromagnetic valve 10 (102Y), for switching the ink supply for the recording head 5 (HY), from the second yellow ink cartridge 2 (Y2) to the first yellow ink cartridge 2 (Y1) (Step S8).

On the contrary, if the CPU 81 judges that the ink residual quantity of the second yellow ink cartridge 2 (Y2) is not less than the predetermined quantity (Step S6; Yes), the process goes to Step S8. In other words, while the second yellow ink cartridge 2 (Y2) supplies ink to the intermediate tank 3 (SY), if the ink residual quantity detecting sensor 4 detects that there is swelling with the intermediate tank 3 (SY) after the predetermined time period has passed, the CPU 81 judges that the ink residual quantity of the second yellow ink cartridge 2 (Y2) is not less than the predetermined quantity. Thereafter, in Step S8, the CPU 81 switches the ink supply for the recording head 5 (HY), from the second yellow ink cartridge 2 (Y2) to the first yellow ink cartridge 2 (Y1).

Next, the CPU 81 stores the identification number "001" of the first yellow ink cartridge 2 (Y1), the ink residual quantity information of the second yellow ink cartridge 2 (Y2) and the like in the EEPROM 84, for establishing a state where information regarding each ink cartridge remains stored even when the power is off. Then, the CPU 81 ends the ink residual quantity detecting process operation (Step S9).

According to the above-described inkjet recording apparatus 1 of the present invention, when it is judged that an ink cartridge exchange is done, an ink cartridge is switched so as to supply ink to the recording head from an exchanged ink cartridge, and if ink residual quantity of the exchanged ink cartridge is not more than predetermined quantity, ink residual quantity information indicating the quantity is not more than the predetermined quantity is displayed. Therefore, since it is possible to confirm ink residual quantity of an ink cartridge to be exchanged subsequently during a recording operation, it is possible to effectively prevent a printing stop or the like which could be caused due to ink residual quantity of the ink cartridge being not more than predetermined quantity, during the recording operation.

Further, if the ink residual quantity detecting sensor 4 detects that the ink residual quantity of the exchanged ink cartridge is not more than predetermined quantity, ink residual quantity information indicating that the quantity is not more than the predetermined quantity is displayed. Thereby, it is possible for a user to easily confirm visually that ink residual quantity of the exchanged ink cartridge is not more than the predetermined quantity.

Further, if it is judged that an ink cartridge exchange is done, ink cartridge information regarding the used first ink cartridge is stored, and after ink residual quantity of the exchanged second ink cartridge is detected, ink supply source is switched from the second ink cartridge to the first ink cartridge based on the stored first ink cartridge information. Therefore, it is possible to confirm ink residual quantity of a second ink cartridge which is to be exchanged subsequently. In addition, since it is possible to use all the ink pooled in the used first ink cartridge, it is economically efficient.

Further, the inkjet recording apparatus 1 according to the present invention is not limited to the above-described embodiment. For example, the inkjet recording apparatus 1 is not limited to the one comprising two ink cartridges 2 of the same color. The inkjet recording apparatus 1 may comprise not less than three ink cartridges 2.

[Second Embodiment]

Next, a second embodiment of the present invention will be described with reference to FIGS. 6, 7 and 8. In the second embodiment, description on the control in the case that there are a plurality of ink cartridges of the same color will be made. Here, in regard to components of the inkjet recording apparatus in the present embodiment, since they are the same as these of the first embodiment, description thereof in detail is omitted.

Figure 6:
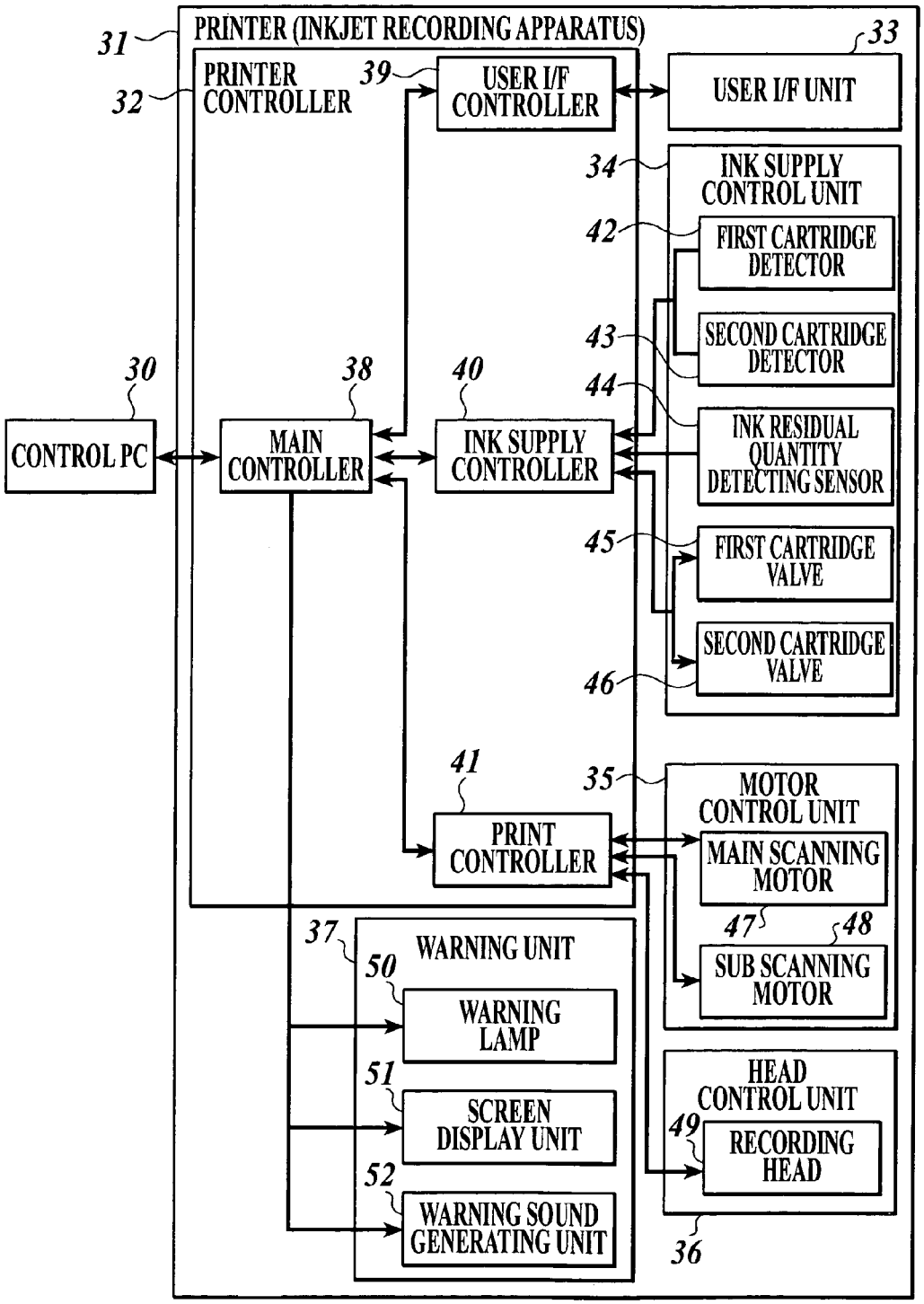
FIG. 6 is a block diagram showing a main control structure of the inkjet recording apparatus according to the present invention.

FIG. 6 is a block diagram showing a main control structure of the inkjet recording apparatus in the second embodiment according to the present invention. As shown in FIG. 6, the main control structure comprises a printer controller 32 which is a control unit for controlling the whole printing operations of the recording apparatus, a user interface unit 33 (hereinafter, it is abbreviated as user I/F unit) for processing information inputted by a user, an ink supply control unit 34 for watching ink residual quantity for controlling ink supply quantity, a motor control unit 35 for controlling the driving of a motor which manages conveyance of a recording medium P and movement of the carriage 6, a head control unit 36 for controlling the jetting of ink, and a warning unit 37 which is a means to inform a user of ink shortage. Warning unit 37 can include warning lamp 50, screen display unit 51, and warning sound generating unit 52. The printer controller 32 comprises, as shown in FIG. 6, a main controller 38 which is electrically connected to a control PC 30, a user IIE controller 39 for controlling the user I/F unit 33, an ink supply controller 40 for controlling the ink supply control unit 34, and a print controller 41 for controlling the motor control unit 35 and the head control unit 36. The main controller 38 is electrically connected to each of the user hF controller 39, the ink supply controller 40 and the print controller 41. Further, the main controller 38 is electrically connected to the warning unit 37 that gives a user warning notice at three levels based on an electric signal indicating an operation state from each unit, when the ink recording apparatus reaches a preassumed status of ink use (this operation will be described later).

The user I/F controller 39 transmits operation information inputted through the user I/F unit 33 by a user, to the main controller 38.

Further, the ink supply controller 40 is electrically connected to a first cartridge presence sensor 42, a second cartridge presence sensor 43, an ink residual quantity detecting sensor 44 provided in the intermediate tank 3, a first cartridge valve 45, and a second cartridge valve 46, each of which is provided within the ink supply control unit 34. The first cartridge presence sensor 42 and the second cartridge presence sensor 43 respectively detect whether a first ink cartridge and a second ink cartridge are set in predetermined positions.

The ink residual quantity detecting sensor 44 is provided in the intermediate tank 3, and detects whether ink residual quantity within the intermediate tank is not more than predetermined quantity. Here, as well as the first embodiment, the ink residual quantity detecting sensor 44 may comprise an optical sensor provided at the upstream side from the intermediate tank and near the supply tube 7 being a passage of ink supplied from each ink cartridge so as to make the light emitting device and the light receiving device face each other, for optically detecting the transmittance within the passage. In this case, as well as the first embodiment, it is preferable to use transparent or translucent pipe, tube or the like to the ink supply tube 7. In this way, it is possible to easily detect whether ink passes within the ink supply tube 7. Thereby, it is possible to surely detect ink residual quantity of the ink cartridge which is currently supplying the ink to the intermediate tank 3.

The first cartridge valve and the second cartridge valve are, as well as the first embodiment of the present invention, electromagnetic valves which are opened/closed according to control by the control unit. Even if a plurality of ink cartridges for supplying ink of the same color to one intermediate tank are provided, as well as the first embodiment, other than to selectively open a valve of an ink cartridge for supplying ink, it is also possible to have all of or some of the ink cartridges to supply ink, or to stop the ink supply from all the ink cartridges as mentioned above, in order to adjust the pressure of supplied ink of the recording head.

Next, an operation of giving warning notice at each level will be described in detail with reference to a flowchart shown in FIG. 7.

At first, a state in which the ink cartridge can become will be described.

Three types can be considered as a state of the ink cartridge, which are a state where there is no ink cartridge (State A), a state where there is an ink cartridge but ink quantity is not more than predetermined quantity (State B), and a state where there is an ink cartridge and ink quantity is not less than predetermined quantity (State C). In the description that will be made in the following, in each step to judge whether there is an ink cartridge, it is assumed that No in FIG. 7 is to be chosen in the State A or the State B, and Yes in FIG. 7 is to be chosen in the State C.

First, after the operation is started, the first cartridge presence sensor detects a state of the first ink cartridge (Step S10), and if there is a first ink cartridge (Step S10; Yes), the first cartridge valve is opened (Step S11) and the ink residual quantity detecting sensor which is provided in the intermediate tank detects ink residual quantity within the intermediate tank (Step S12). If ink quantity within the intermediate tank is full (Step S12; Yes), the first cartridge valve is closed (Step S13), and thereafter, the ink residual quantity within the intermediate tank is repeatedly confirmed (Step S14). Then, if it is detected that the ink residual quantity is not full (Step S14; No), the process returns to the operation to open the first cartridge valve. If predetermined time period has passed without ink residual quantity within the intermediate tank reaching full (Step S12; No & Predetermined Time Period Passed), first warning notice is given (Step S16), and sequentially, the process goes to an operation to confirm a state of a second ink cartridge (Step S17). If there is a second ink cartridge (Step S17; Yes), the second cartridge valve is opened (Step S18), and if there is no second ink cartridge, the process proceeds to the operation to re-confirm whether there is a first ink cartridge (Step S23).

If there is no first ink cartridge or stored information indicates that the first ink cartridge is already empty (Step S10; No), a state of the second ink cartridge is confirmed (Step S15). If the second cartridge presence sensor detects that there is a second ink cartridge (Step S15; Yes), the second cartridge valve is opened (Step S18). Thereafter, as well as the case of the first ink cartridge, the ink residual quantity detecting sensor detects ink residual quantity within the intermediate tank (Step S19). If ink residual quantity within the intermediate tank is full (Step S19; Yes), the second ink cartridge valve is closed (Step S20) and the ink residual quantity within the intermediate tank is repeatedly detected (Step S21). If ink residual quantity within the intermediate tank becomes not full (Step S21; No), the second cartridge valve is re-opened for supplying ink (Step S18). If predetermined time period has passed without ink residual quantity within the intermediate tank reaching full (Step S19; No & Predetermined Time Period Passed), the first warning notice is given (Step S22) and continuously a state of the first ink cartridge is confirmed (Step S10).

After it is detected that the first ink cartridge is empty and the first warning notice is given (Step S16), if it is detected that there is no second ink cartridge (Step S17; No), the process again goes to the operation to judge whether there is a first ink cartridge (Step S23). Here, if there is a first ink cartridge (Step S23; Yes), the first cartridge valve is opened and the process goes to the same operation as above-mentioned, and if there is no first ink cartridge (Step S23; No), second warning notice is given (Step S24). Further, if it is detected that there is no first ink cartridge (or the first ink cartridge is empty) and there is no second ink cartridge (Step S15; No), the second warning notice is also given (Step S24).

Figure 7:
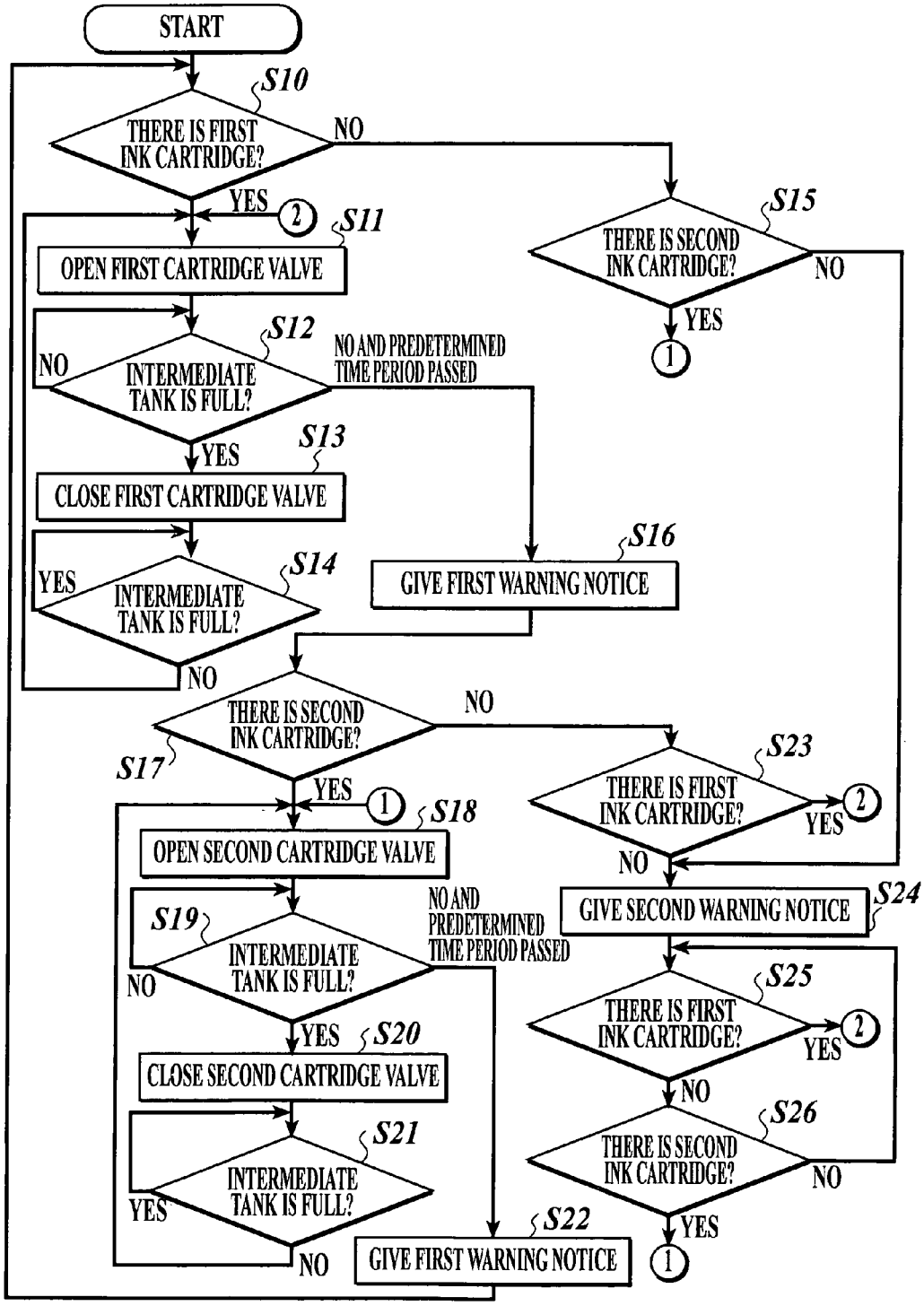
FIG. 7 is a flowchart illustrating an operation of an ink supply control unit of the inkjet recording apparatus according to the present invention.

After the second warning notice is given, as shown in FIG. 7, sequentially it is confirmed whether there is a first ink cartridge (Step S25) and whether there is a second ink cartridge (Step S26). If it is detected that an ink cartridge is exchanged, a process to supply ink from the exchanged cartridge is performed.

By repeating the above-mentioned operations sequentially, the operation is controlled to give the first warning notice when ink residual quantity of one of the first ink cartridge and the second ink cartridge is empty, and to give the second warning notice when ink residual quantity of both the first ink cartridge and the second ink cartridge is empty.

Next, with reference to FIG. 8, a procedure from giving the second warning notice to performing a printing completion process in the present embodiment will be described in detail. Here, it is assumed that, before the operation illustrated as a flowchart shown in FIG. 8, the control for giving the first warning notice and the second warning notice has already been done.

Figure 8:
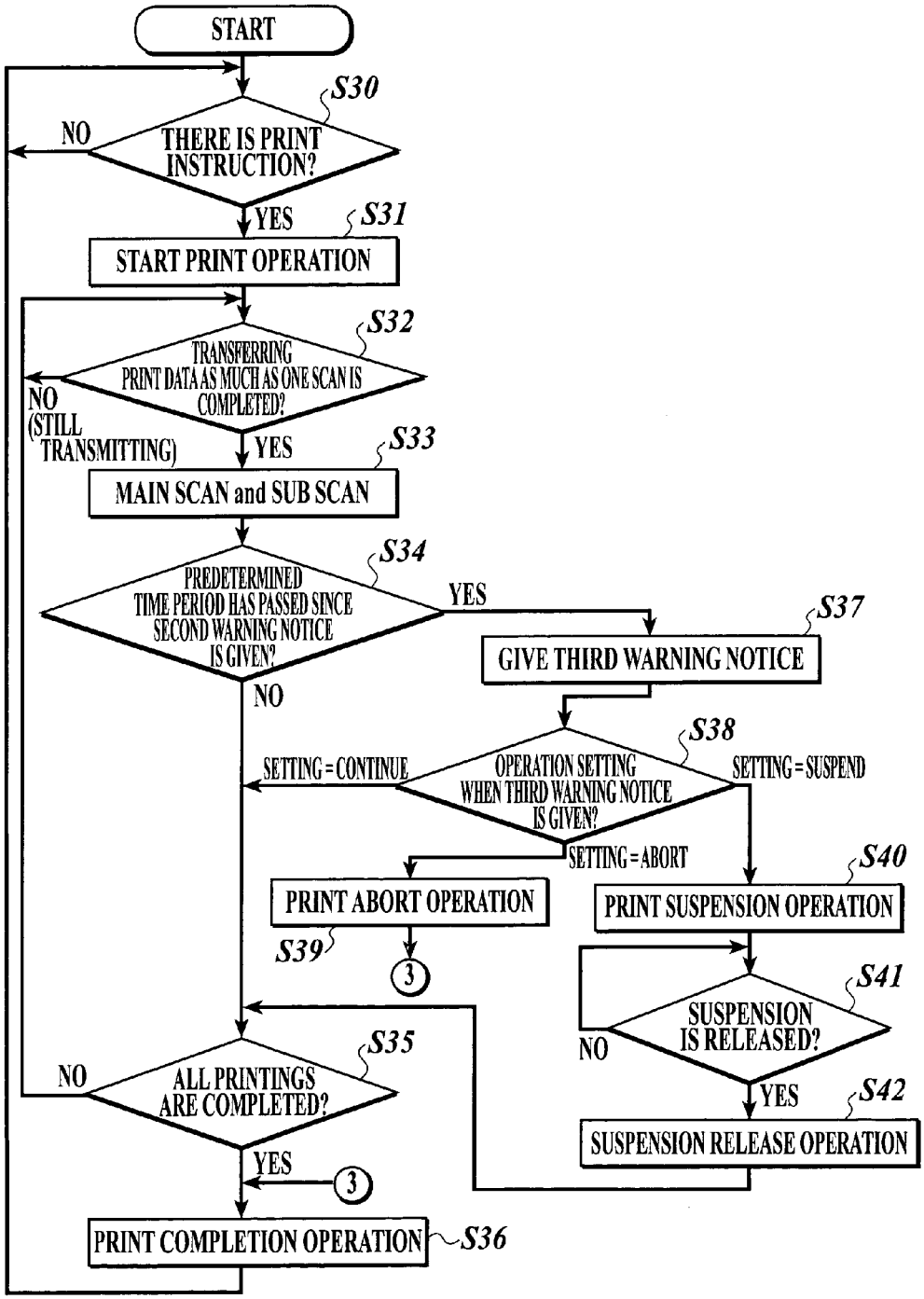
FIG. 8 is a flowchart illustrating an operation of a print control unit of the inkjet recording apparatus according to the present invention.

FIG. 8 is a flowchart illustrating an operation principle of the printer control unit in the second embodiment of the present invention.

After the operation is started, the printer control unit stands by until a print instruction is transmitted (Step S30), and when a print instruction is transmitted (Step S30; Yes), the printer control unit performs a print start operation (Step S31). Thereafter, the printer control unit waits for print data as much as one scan to be transmitted (Step S32), and when the transmission is completed (Step S32; Yes), the printer control unit moves the recording head 5 by moving the carriage 6 along the main scanning direction A and moves the recording medium P along the sub scanning direction B for recording (Step S33).

Next, the printer control unit judges whether predetermined time period has passed since the second warning notice is given (Step S34). If the predetermined time period has not passed (Step S34; No), the printer control unit judges whether all the printings are completed (Step S35), and if all the printings are not completed (Step S35; No), the printer control unit waits for next print data as much as one scan to be transmitted (Step S32). If all the printings are completed (Step S35; Yes), the printer control unit performs the print completion operation (Step S36) and again stands by to wait for a print instruction to be transmitted Step S30).

If the predetermined time period has passed since the second warning notice is given (Step S34; Yes), third warning notice is given (Step S37).

After the third warning notice is given, according to a user setting, a print completion process thereafter can take three alternatives (Step S38).

If the user setting is "continue" (Step S38; CONTINUE), the printing is continued after the third warning notice is given, and when all the printings are completed, the print completion process is performed.

If the user setting is "abort" (Step S38; ABORT), a print abort operation is performed after the third warning notice is given (Step S39), and even if all the printings are not completed at the moment, the printing operation is aborted immediately and the print completion operation is performed.

If the user setting is "suspend" (Step S38; SUSPEND), a suspension operation is performed after the third warning notice is given (Step S40). Then, an instruction to release the suspension by a user is awaited (Step S41; No), and if the instruction to release the suspension is given (Step S41; Yes), a suspension resume operation is performed (Step S42) and the printing operation is resumed.

According to the above-described inkjet recording apparatus 1 in the second embodiment of the present invention, it is of course possible to obtain the same effects as the first embodiment, and moreover in particular, if ink residual quantity of all the ink cartridges becomes not more than predetermined quantity, since it is possible to select to continue, to abort or to suspend the printing operation thereafter, it is possible to prevent a printing stop due to the shortage of ink residual quantity, and also it is possible to perform a printing operation complying with a user's desire. Further, it is possible to prevent from wasting ink or recording medium due to unnecessary printings.

Here, two or not less than three recording heads for recording images may be provided. In this case, to each of a plurality of recording heads which jet ink of the same color, ink is supplied from one or a plurality of ink cartridge(s) through an intermediate tank which temporarily pools the ink.

ALTERNATIVE EXAMPLE

Figure 9:
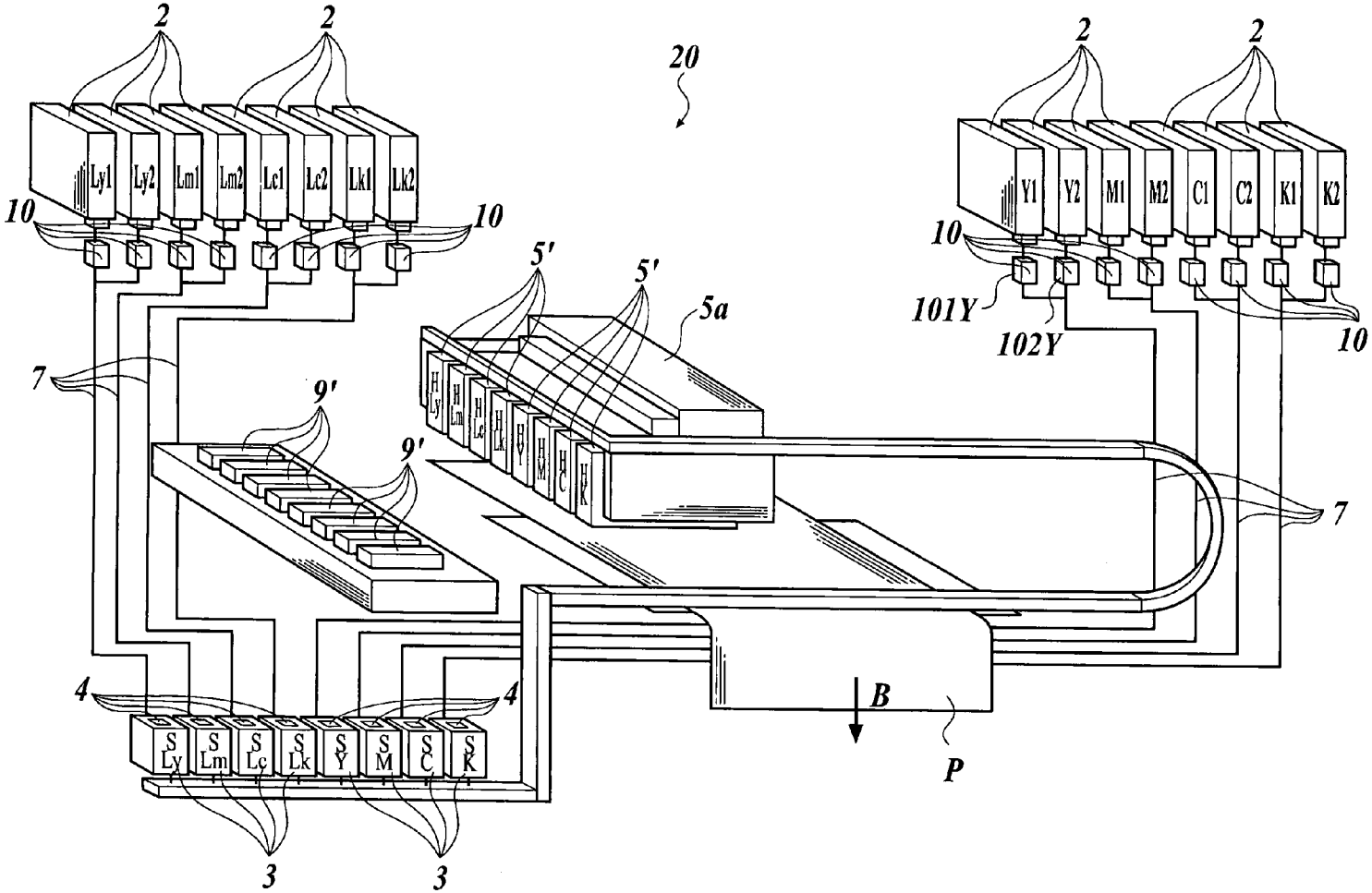
FIG. 9 is a view showing a whole structure of an alternate example of the inkjet recording apparatus according to the present invention.

FIG. 9 is a view showing a whole structure of an alternative example of the inkjet recording apparatus of FIG. 1. The inkjet recording apparatus 20 shown in FIG. 9 is arranged along a conveyance direction B of paper P, and it comprises line heads 5' which function as recording heads, a fixing member 5*a* for fixing the line heads 5', home positions 9' which are arranged along a perpendicular direction to the conveyance direction B of paper P and which allow the line heads 5' to stand by when the line heads 5' are not involved with a recording operation, and the like. Here, since the inkjet recording apparatus 20 is different from the inkjet recording apparatus 1 only in the aspect of comprising the line heads 5', the fixing member 5*a* and the home positions 9', identical numerals are assigned to the same structure as the inkjet recording apparatus 1, and description of the same part is omitted.

Further, a recording operation of the ink-jet recording apparatus 20 is done by jetting ink as minute droplet toward a recording surface of the paper P from a plurality of nozzles (illustration omitted), which are provided in each line head 5'.

As well as the case of the inkjet recording apparatus 1 shown in FIG. 1, which performs the recording with the use of the recording heads 5 mounted on the carriage 6, in the inkjet recording apparatus 20 shown in FIG. 9, which performs the recording on recording medium P with the use of the line heads 5', if it is judged that an ink cartridge exchange is done, an ink cartridge is switched so as to supply ink for the line heads from an exchanged ink cartridge, and if ink residual quantity of the exchanged ink cartridge is not more than predetermined quantity, ink residual quantity information indicating that the quantity is not more than the predetermined quantity is displayed. Therefore, since it is possible to confirm ink residual quantity of an ink cartridge to be exchanged subsequently during a recording operation, it is possible to effectively prevent a printing stop or the like which could be caused due to ink residual quantity of the ink cartridge becoming not more than predetermined quantity, during the recording operation. And so forth, it is possible to obtain the same effects as the inkjet recording apparatus 1.

Further, informing a user of ink residual quantity information may be done by sound such as an alarm or the like, other than by displaying the information on the display unit.

Further, as a method for detecting ink residual quantity of the ink cartridge 2 may be done by measuring ink flow quantity passed through the ink supply tube 7 with a flowmeter provided in the ink supply tube, by measuring pressure fluctuation of the ink supply tube 7, by measuring weight of the intermediate tank 3, or the like.

Further, in the embodiment above, described is ink supply from the ink cartridge 2 with exemplifying yellow (Y). However, needless to say, the ink cartridges 2 of other colors have the same structure.

The entire disclosure of a Japanese Patent Application No. Tokugan 2004-027557, including specifications, claims, drawings and summaries are incorporated herein by reference in their entirety.

What is claimed is:

1. An inkjet recording apparatus comprising:

a first ink cartridge which is exchangeable;

a second ink cartridge which is exchangeable;

a recording head which jets ink to a recording medium;

an intermediate tank which receives the ink selectively from the first ink cartridge or the second ink cartridge, the intermediate tank supplying the received ink to the recording head;

a detecting sensor which detects whether ink residual quantity of an ink cartridge supplying the ink is not more than first predetermined quantity, based on quantity of the ink in the intermediate tank;

a switching section which, if the detecting sensor detects that the ink residual quantity of the ink cartridge supplying the ink is not more than the first predetermined quantity, switches the ink cartridge to another ink cartridge for supplying the ink to the intermediate tank;

a first detector which detects whether the first ink cartridge is reset to the inkjet recording apparatus;

a second detector which detects whether the second ink cartridge is reset to the inkjet et recording apparatus; and at least one controller which, if the first detector detects that the first ink cartridge is reset, controls the switching section to switch from the second ink cartridge to the first ink cartridge, for supplying the ink to the intermediate tank, and which controls the switching section to switch the ink cartridge for supplying the ink to the intermediate tank from the first ink cartridge to the second ink cartridge, when the ink residual quantity of the first ink cartridge is detected by the detecting sensor and is more than the first predetermined quantity after the ink cartridge for supplying the ink to the intermediate tank is switched to the first ink cartridge by the first controller.

2. The apparatus of claim 1, wherein the first ink cartridge and the second ink cartridge pool the ink of a same color.

3. The apparatus of claim 1, wherein the detecting sensor detects whether the ink residual quantity of the ink cartridge supplying the ink is not more than the first predetermined quantity, based on a swelling degree of the intermediate tank.

4. The apparatus of claim 1, further comprising a first warning section which gives a first warning notice if the detecting sensor detects that the ink residual quantity of the ink cartridge supplying the ink is not more than the first predetermined quantity.

5. The apparatus of claim 4, further comprising a second warning section which gives a second warning notice if the detecting sensor detects that the ink residual quantity of both the first ink cartridge and the second ink cartridge is not more than the first predetermined quantity.

6. The apparatus of claim 5, further comprising a third warning section which gives a third warning notice if resetting of the first ink cartridge and the second ink cartridge has not been detected for a predetermined time period since the second warning notice is given.

7. The apparatus of claim 6, further comprising a stopping section which stops a jetting operation of the recording head if the third warming notice is given.

8. The apparatus of claim 7, further comprising a resuming section which, after the jetting operation is stopped, resumes the jetting operation if the resetting of the first ink cartridge or the second ink cartridge is detected and the ink residual quantity of the intermediate tank is not less than a second predetermined quantity.

9. The apparatus of claim 6, wherein the first warning notice, the second warning notice and the third warning notice are different types of warning from one another.

10. An inkjet recording apparatus comprising:

a plurality of ink cartridges each of which is exchangeable;

a recording head which jets ink to a recording medium;

a passage which receives the ink selectively from the plurality of ink cartridges;

an intermediate tank which receives the ink from the passage and which supplies the received ink to the recording head, the intermediate tank being provided at a downstream side of the passage;

a detecting sensor which is provided near the passage and which detects whether ink residual quantity of an ink cartridge supplying the ink is not more than predetermined quantity;

a switching section which, if the detecting sensor detects that the ink residual quantity of the ink cartridge supplying the ink is not more than the predetermined quantity, switches the ink cartridge to another one of the plurality of ink cartridges for supplying the ink to the intermediate tank;

a detector which detects whether a certain ink cartridge is set to the inkjet recording apparatus; and at least one controller which, if the detector detects that an ink cartridge is reset, controls the switching section to switch the ink cartridge to the reset ink cartridge for supplying the ink to the intermediate tank, and which controls the switching section to switch the ink cartridge for supplying the ink to the intermediate tank from the reset ink cartridge to the ink cartridge, when the ink residual quantity of the reset ink cartridge is detected by the detecting sensor and is more than the predetermined quantity after the ink cartridge for supplying the ink to the intermediate tank is switched to the reset ink cartridge by the first controller.

11. The apparatus of claim 10, wherein the detecting sensor detects presence of the ink within the passage.

12. The apparatus of claim 11, wherein the detecting sensor comprises an optical sensor which optically detects transmittance within the passage.

13. The apparatus of the claim 10, wherein the plurality of ink cartridges pool the ink of a same color.

14. An inkjet recording apparatus comprising:

a first ink cartridge which is exchangeable;

a second ink cartridge which is exchangeable;

a recording head which jets ink to a recording medium;

a switching section which switches an ink supply source for the recording head to the first ink cartridge or the second ink cartridge;

a detecting sensor which detects whether ink residual quantity of an ink cartridge supplying the ink is not more than predetermined quantity, based on ink residual quantity of the intermediate tank;

a first detector which detects whether the first ink cartridge is reset to the inkjet et recording apparatus;

a second detector which detects whether the second ink cartridge is reset to the inkjet recording apparatus; and at least one controller which, if the first detector detects that the first ink cartridge is reset, controls the switching section to switch the ink supply source for the recording head to the first ink cartridge, and which controls the switching section to switch the ink cartridge for supplying the ink to the intermediate tank from the first ink cartridge to the second ink cartridge, when the ink residual quantity of the first ink cartridge is detected by the detecting sensor and is more than the predetermined quantity after the ink cartridge for supplying the ink to the intermediate tank is switched to the first ink cartridge by the first controller.

15. The apparatus of claim 14, wherein the first ink cartridge and the second ink cartridge pool the ink of a same color.

16. The apparatus of claim 14, further comprising:

an intermediate tank which receives the ink selectively from the first ink cartridge and the second ink cartridge and which supplies the received ink to the recording head; and a switching section which, if it is detected that the ink residual quantity of the ink cartridge supplying the ink is not more than the predetermined quantity, switches the ink cartridge to another ink cartridge for supplying the ink to the intermediate tank.

17. The apparatus of claim 16, wherein the detecting sensor detects whether the ink residual quantity of the ink cartridge supplying the ink is not more than the predetermined quantity, based on a swelling degree of the intermediate tank.

18. The apparatus of claim 16, further comprising a first warning section which, if the detecting sensor detects that the ink residual quantity of the ink cartridge supplying the ink is not more than the predetermined quantity, gives a first warning notice.

19. The apparatus of claim 18, further comprising a second warning section which, if the detecting sensor detects that the ink residual quantity of both the first ink cartridge and the second ink cartridge is not more than the predetermined quantity, gives a second warning notice.

20. The apparatus of claim 19, further comprising a third warning section which, if resetting of the first ink cartridge and the second ink cartridge has not been detected for a predetermined time period since the second warning notice is given, gives a third warning notice.

* * * * *